United States Patent [19]

Payer

[11] Patent Number: 4,862,908

[45] Date of Patent: Sep. 5, 1989

[54] MINERAL OILS AND MINERAL OIL DISTILLATES HAVING IMPROVED FLOWABILITY AND METHOD FOR PRODUCING SAME

[75] Inventor: Wolfgang Payer, Wesel, Fed. Rep. of Germany

[73] Assignee: Ruhrchemie Aktiengesellschaft, Fed. Rep. of Germany

[21] Appl. No.: 72,803

[22] Filed: Jul. 14, 1987

[30] Foreign Application Priority Data

Jul. 17, 1986 [DE] Fed. Rep. of Germany ..... 3624147

[51] Int. Cl.[4] ..... C10L 1/16

[52] U.S. Cl. ..... 137/13; 44/62; 137/1; 585/12; 585/13

[58] Field of Search ..... 44/62; 585/9, 12, 13; 137/13

[56] References Cited

U.S. PATENT DOCUMENTS

| | | | |
|---|---|---|---|
| 2,875,029 | 2/1959 | McReynolds | 44/70 |
| 3,250,594 | 5/1966 | Kirk et al. | 44/62 |
| 3,288,577 | 11/1966 | Patinkin | 44/62 |
| 3,341,309 | 9/1967 | Ilnckyj | 44/62 |
| 3,388,977 | 6/1968 | Burkard | 44/62 |
| 3,389,979 | 6/1968 | Brownawell | 585/13 |
| 3,434,379 | 7/1969 | Isaacson | 44/62 |
| 3,454,379 | 7/1969 | Isaacson et al. | 44/62 |
| 3,462,249 | 8/1969 | Tunkel | 44/62 |
| 3,660,057 | 5/1972 | Ilnckyj | 585/3 |
| 3,883,318 | 5/1975 | Feldmen et al. | 585/3 |
| 3,904,385 | 9/1975 | Sweeney | 44/62 |
| 4,019,878 | 4/1977 | Wisolsky | 44/62 |
| 4,108,612 | 8/1978 | Rossi et al. | 44/62 |
| 4,178,950 | 12/1979 | Sweeney | 44/62 |
| 4,178,951 | 12/1979 | Sweeney | 44/62 |
| 4,375,973 | 3/1983 | Rossi et al. | 44/62 |
| 4,661,122 | 4/1987 | Lewtas | 44/62 |

FOREIGN PATENT DOCUMENTS

| | | | |
|---|---|---|---|
| 99646 | 6/1983 | European Pat. Off. . | |
| 184048 | 6/1986 | European Pat. Off. . | |
| 196217 | 10/1986 | European Pat. Off. . | |
| 0154869 | 4/1982 | Fed. Rep. of Germany | 44/62 |

*Primary Examiner*—H. M. S. Sneed
*Assistant Examiner*—Helane Myers
*Attorney, Agent, or Firm*—Jordan B. Bierman

[57] ABSTRACT

The flowability of mineral oils and mineral oil distillates is improved by the addition of mixtures of an ethylene-vinyl acetate-diisobutylene terpolymer, an oxidized polyethylene wax and/or an oxidized ethylene-vinyl acetate copolymer.

25 Claims, No Drawings

MINERAL OILS AND MINERAL OIL DISTILLATES HAVING IMPROVED FLOWABILITY AND METHOD FOR PRODUCING SAME

The present invention relates to a process to improve the flowability of mineral oils and mineral oil distillates by the addition of mixtures of an ethylene-vinyl acetate-diisobutylene terpolymer and an oxidized polyethylene wax and/or an oxidized ethylene-vinyl acetate copolymer, as well as products made in accordance therewith.

Mineral oils such as crude oil, diesel fuel, or heating oil contain dissolved paraffin which crystallizes out at low temperatures. These solid deposits often lead to breakdowns during the recovery and use of mineral oils. For example, the functioning of crude oil conveyance and transport facilities can be impaired to such a degree that they fail. In diesel engines, furnaces, and boiler plants, the filters can become blocked resulting in the supply of road fuel or heating oil being interrupted.

In order to avoid this undesirable formation of solids, additives counteracting the formation of paraffin crystals are added to the mineral oils. Thus, an increase in the oil viscosity is prevented and its pour-point is lowered.

Copolymers of ethylene and carboxylic acid esters of vinyl alcohol have gained great significance as pour-point depressants and flow improvers for crude oils and middle distillates. Of these, ethylene-vinyl acetate copolymers have proved to be particularly useful. Such copolymers and their use are described, for example, in DE-PS No. 19 14 756. They are generally prepared by the copolymerization of monomers in autoclaves at temperatures of 80° to 150° C. and pressures of 5 to 15 MPa in the presence of peroxides as initiators and organic solvents as reaction media.

In practice it has been shown that the effectiveness of these copolymers as flow improvers depends on the properties of the mineral oils and mineral oil distillates whose flowability is to be improved. With middle distillates, for example, it is influenced, among other things, by the total content of n-paraffins and the content of n-paraffins of certain chain lengths.

It is therefore understandable that the ethylene-vinyl acetate copolymers do not always show the desired effect despite their excellent suitability for increasing the flowability. In such cases, a makeshift solution is to add them in large quantities or to mix the mineral oil or the mineral oil distillates with low-boiling hydrocarbons.

The effectiveness of flow improvers may also be increased by employing additive combinations. For example, in DE No. 26 39 672, mixtures of polymers with an ethylene skeleton and copolymers of $C_2$ to $C_{50}$ olefins are described which can lead to a synergistic improvement of the flow properties of distillate hydrocarbon oils in cold weather.

According to U.S. Pat. No. 3,660,057 mixtures of an ethylene-vinyl acetate copolymer and a solid hydrocarbon which is free of n-paraffins, are employed as flow improvers. In U.S. Pat. No. 4,019,878 mixtures consisting of an ethylene-containing polymer, bees' wax, ozocerite and/or long-chain alpha-olefins are disclosed as flow improvers for crude oil middle distillates.

Although the known substances and substance mixtures have, in many cases, improved the flowability of mineral oils and mineral oil distillates of different origins and compositions at low temperatures, the improvement being partly appreciable, there is still a lack of additives which are versatile and, ideally, universal in their application. Therefore, the problem consisted in finding additives which have an even greater range of application than the flow improvers. They should also increase the flowability of those oils on which the known additives have little or no effect.

These objects are achieved by adding mixtures of an ethylene-vinyl acetate-diisobutylene terpolymer and an oxidized polyethylene wax and/or an oxidized polyethylene-vinyl acetate copolymer to the mineral oils or mineral oil distillates.

Surprisingly, it has been found that the combination of ethylene-vinyl acetate-diisobutylene terpolymers with oxidized polyethylene waxes and/or oxidized ethylene-vinyl acetate copolymers effectively suppresses the crystallization of paraffins from mineral oils and mineral oil distillates. These additives prevent an increase in the viscosity of the hydrocarbon mixtures at lower temperatures and reduce the pour-point. The new process has proved its worth in improving the flowability of mineral oils and their distillation products, irrespective of their qualitative and quantitative composition.

The ethylene-vinyl acetate-diisobutylene terpolymers employed in accordance with the invention advantageously contain 25 to 78 parts by weight of vinyl acetate and 0.5 to 45 parts by weight of diisobutylene per 100 parts by weight of ethylene. Terpolymers with 30 to 55 parts by weight of vinyl acetate and 1.0 to 27.5 parts by weight of diisobutylene per 100 parts by weight of ethylene have proved to be particularly suitable.

The average mol mass of the terpolymers measured by vapor pressure osmomometry is 500 to 10,000 g/mol, preferably 1000 to 5000 g/mol and, in particular, 1500 to 3500 g/mol.

Based on 100 $CH_2$ groups in the terpolymer, they have 6 to 20, preferably 7 to 15, $CH_3$ groups in the side chains not originating from the acetate group of the vinyl acetate. The number of CH groups is determined by H-NMR spectroscopy.

The preparation of ethylene-vinyl acetate-diisobutylene terpolymers is known. They can, for example, be produced by the polymerization of the monomer mixture at pressures above 50 MPa and temperatures of 150° to 350° C. in the presence of oxygen or radical-forming initiators in autoclaves or tubular reactors.

Diisobutylene is a mixture consisting mainly of 2,4,4-trimethylpentene-1- and 2,4,4-trimethylpentene-2. It is formed through the dimersation of isobutylene (2-methylpropene) with acidic catalysts (e.g. ion exchangers).

The term oxidized polyethylene waxes is understood to mean products which are obtained by the treatment of melts of linear or branched polyethylene waxes with oxygen or oxygen containing gases. They are waxes which contain oxygen functions such as carboxyl, carbonyl, and hydroxyl groups in the molecule. They are characterized above all by their emulsifiability in aqueous media. The wax oxides used in accordance with the invention have melting points of 85° to 135° C., dropping points (determined according to DIN 51801 or ASTM D 566) of 95° to 135° C., and densities of 0.94 to 1.00 g/cm$^3$. Their acid numbers (measured according to DIN 53402 or ASTM D 1386) are 5 to 60 mg KOH/g, and the viscosimetrically determined mol masses are 500 to 10,000 g/mol. Oxidized polyethylene waxes with dropping points of 100° to 120° C. and acid numbers of 8 to 30 mg KOH/g are preferred. Such waxes are available as proprietary products; they are marketed, for example, under the names "Hoechst wax PED" (manufacturer: Hoechst AG) or "polyethylene wax OA" (manufacturer: BASF AG).

Oxidized ethylene-vinyl acetate copolymers are the products of the oxidation of melted ethylene-vinyl acetate copolymers with oxygen or oxygen-containing gases. Their preparation is described, for example, in DE No. 29 44 375. In accordance with the present invention, oxidized ethylene-vinyl acetate copolymers exhibiting dropping points of 80° to 110° C. and acid numbers of 5 to 200 mg KOH/g are employed. The dropping point is determined, as in the case of oxidized polyethylene waxes, in accordance with DIN 51801 or ASTM D 566. The acid number is measured as set forth in DIN 53402 or ASTM D 1386.

The mixtures added in accordance with the invention to improve the flowability of mineral oils and mineral oil distillates consist of two or three components. They always contain ethylene-vinyl acetate-diisobutylene terpolymers and, in addition, oxidized polyethylene waxes or oxidized ethylene-vinyl acetate copolymers. In a further embodiment according to a new procedure, an ethylene-vinyl acetate diisobutylene terpolymer is employed together with both the oxidized polyethylene wax and the oxidized ethylene-vinyl acetate copolymer.

The weight ratio of the terpolymer to the wax and/or the copolymer is advantageously 1000:1 to 1:10; a ratio of 100:1 to 1:5 is preferred.

The process according to the invention improves both the flowability of mineral oils as well as that of mineral oil distillates. Mineral oils are understood to be, in particular, crude oils and distillation residues such as heavy heating oil. Mineral oil distillates are hydrocarbon fractions with boiling points between about 150° and 400° C. This classification includes petroleum, light heating oils and diesel fuel. The middle distillates, such as extra light heating oil and diesel fuel, are of particular importance. The mixture of the various polymers is added to the mineral oils and mineral oil distillates in the form of solutions containing 20 to 70% by weight of the polymers, based on the solution. Aliphatic or aromatic hydrocarbon mixtures, e.g. gasoline fractions, are useful as solvents; kerosene is particularly suitable. The mineral oil or mineral oil fractions should contain 0.001 to 2%, preferably 0.005 to 0.5%, by weight of the polymers of the present invention. The polymer mixtures can be used alone or together with other additives, e.g. with other pour-point depressants or dewaxing agents, with corrosion inhibitors, antioxidants, sludge inhibitors and additives for reducing the cloud point.

The process according to the invention is explained in greater detail by the following examples:

Examples 1 to 5, 7 and 8 relate to the process according to the invention. In Example 6, the results of comparative experiments using an ethylene-vinyl acetate-diisobutylene terpolymer as a flow improver are given.

The effectiveness of the processes investigated in improvement of flowability is described with the aid of the cold flow plugging point test (CFPP). The test is carried out according to DIN 51428; it is also published in the J. of the Inst. of Petr., Volume 52, June 1966, pages 173 to 185. For test purposes, four middle distillates, M1, M2, M3, and M4, characterized by the properties listed in Table 1, are employed.

TABLE 1

| Characteristics of the Middle Distillates | M1 | M2 | M3 | M4 |
|---|---|---|---|---|
| Boiling analysis (°C.) | | | | |
| Start of boiling | 180 | 163 | 163 | 233 |
| 5% | 202 | 190 | 191 | 255 |
| 50% | 297 | 271 | 272 | |
| 90% | 357 | | | 371 |
| 95% | | 364 | 381 | |
| End of boiling | 357 | 372 | 385 | 390 |
| Cloud point (°C.) (DIN 51597) | 7 | 5 | 8 | 9 |
| CFPP value (°C.) | 1 | −2 | 1 | 5 |
| n-Paraffins content (%) | 39.1 | 32.6 | 26.8 | 47.5 |

In the following examples the following polymers are employed:

A. The product of copolymerization of ethylene, vinyl acetate and diisobutylene in an autoclave at 200° C. and 150 MPa in the presence of a peroxide as an initiator. The product contains 38.2 parts by weight of vinyl acetate and 5.6 parts by weight of diisobutylene per 100 parts by weight of ethylene and has a mol mass of 1840 g/mol and 8.2 $CH_3$ groups in the side chains not originating from the acetate group of the vinyl acetate per 100 $CH_2$ groups.

B. An oxidized polyethylene wax with a melting point of 107° C., a dropping point (according to DIN 51801) of 107° C., a density of 0.97 g/cm$^3$, an acid number (according to DIN 53402) of 9 mg KOH/g, a saponification number (according to DIN53401) of 28 mg KOH/g, and a mol mass of 2700 g/mol.

C. An oxidized ethylene-vinyl acetate copolymer with a melting point of 98° C., a dropping point (according to DIN 51801) of 99° C., an acid number (according to DIN 53402) of 20 mg KOH/g, a saponification number (according to DIN 53401) of 86 mg KOH/g, and a mol mass of 1900 g/mol.

The vinyl acetate content in the polymers is determined using the pyrolysis method. 200 mg of the polymer are heated to 450° C. with 300 mg of pure polyethylene in a pyrolysis flask for 5 minutes and the cracked gases are taken up in a 250 ml conical flask. The acetic acid formed is reacted with a NaI/KIO solution and the iodine released is titrated with $Na_2S_{22}O_3$ solution. The diisobutylene content in the polymer is determined by 13 C-NMR-spectroscopy.

Table 2 contains the result of the test on the effectiveness of the process according to the invention to improve the flowability of mineral oils and mineral oil distillates.

TABLE 2

| Effectiveness of the polymer mixtures | | | | | | |
|---|---|---|---|---|---|---|
| | Polymer mixtures | | | | | |
| Example | Composition (weight-parts) | Concentration (ppm) | CFPP value (°C.) M1 | M2 | M3 | M4 |
| 1 | 90A + 10C | 0 | +1 | −2 | +1 | +5 |
| | | 100 | −8 | −4 | −5 | |
| | | 400 | −18 | −11 | −15 | −4 |
| 2 | 95A + 5C | 0 | | | | |
| | | 100 | −7 | −3 | −1 | |
| | | 400 | −12 | −16 | −15 | −3 |
| 3 | 80A + 20C | 0 | | | | |
| | | 100 | −7 | −3 | −6 | |
| | | 400 | −13 | −11 | −15 | +5 |
| 4 | 90A + 10B | 0 | | | | |
| | | 100 | −7 | −4 | 0 | |
| | | 400 | −12 | −15 | −14 | −4 |

TABLE 2-continued

| Example | Composition (weight-parts) | Concentration (ppm) | CFPP value (°C.) M1 | M2 | M3 | M4 |
|---|---|---|---|---|---|---|
| | Effectiveness of the polymer mixtures | | | | | |
| | Polymer mixtures | | | | | |
| 5 | 80A + 20B | 0 | | | | |
| | | 100 | −4 | −3 | −8 | |
| | | 400 | −12 | −16 | −14 | −4 |
| 6 | 100A | 0 | | | | |
| | | 100 | −9 | −4 | −2 | |
| | | 400 | −14 | −11 | −15 | −5 |
| 7 | 95A + 5B | 0 | | | | |
| | | 100 | −7 | −6 | −1/−2 | |
| | | 400 | −16 | −14 | −15 | −2/−7 |
| 8 | 50A + 50B | 0 | | | | |
| | | 100 | −5 | −3 | −7 | |
| | | 400 | −9 | −5 | −17 | −2 |

I claim:

1. A method of improving the flowability of mineral oils, mineral oil distillates, or mixtures thereof, said method comprising the addition thereto of an amount effective to improve flowability of an additive comprising an ethylene-vinylacetate-diisobutylene terpolymer and at least one of an oxidized polyethylene wax and an oxidized ethylene-vinylacetate copolymer.

2. The method of claim 1 wherein said ethylene-vinyl acetate-diisobutylene terpolymer comprises 25 to 78 parts by weight of vinyl acetate, and 0.5 to 45 parts by weight of diisobutylene per 100 parts by weight of said ethylene.

3. The method of claim 2 wherein said terpolymer comprises 30 to 55 parts by weight vinyl acetate and 1.0 to 27.5 parts by weight of diisobutylene per 100 parts by weight of said ethylene.

4. The method of claim 1 wherein the average mol mass of said terpolymer, measured by vapor pressure osmometry is 500 to 10,000 g/mol.

5. The method of claim 4 wherein said average mol mass is 1,000 to 5,000 g/mol.

6. The method of claim 5 wherein said average mol mass is 1,500 to 3,500 g/mol.

7. The method of claim 1 wherein said terpolymer has 6 to 20 $CH_3$ groups in its side chains not originating from the acetate group of the vinyl acetate per 100 $CH_2$ groups in said terpolymer.

8. The method of claim 7 wherein said terpolymer has 7 to 15 $CH_3$ groups in side chains per 100 $CH_2$ groups in said terpolymer.

9. The method of claim 1 wherein said wax has a melting point of 85° to 135° C., a dropping point of 95° to 135° C., a density of 0.94 to 1.00 g/cm$^3$, an acid number of 5 to 60 mg KOH/g, and an average mol mass of 500 to 10,000 g/mol.

10. The method of claim 9 wherein said wax has a dropping point of 100° to 120° C. and an acid number of 8 to 30 mg KOH/g.

11. The method of claim 1 wherein said copolymer has a dropping point of 80° to 110° C. and an acid number of 5 to 200 mg KOH/g.

12. The method of claim 1 wherein the weight ratio of said terpolymer to said wax and/or said copolymer is 1000:1 to 1:10.

13. The method of claim 12 wherein said ratio is 100:1 to 1:5.

14. A material comprising mineral oil or mineral oil distillate comprising 0.001 to 2% by weight, based on said mineral oil or mineral oil distillate, of a mixture of an ethylene-vinyl acetate-diisobutylene terpolymer and an oxidized polyethylene wax and/or an oxidized ethylene-vinyl acetate copolymer.

15. The material of claim 14 comprising 0.005 to 0.5% by weight, based on said mineral oil or mineral oil distillate, of said mixture.

16. The material of claim 14 wherein a. said terpolymer comprises 25 to 78 parts by weight of vinyl acetate and 0.5 to 45 parts by weight of diisobutylene, per 100 parts by weight of ethylene, an average mol mass, measured by vapor pressure osmometry, of 500 to 10,000 g/mol and a range of 6 to 20 $CH_3$ groups in its side chains not originating from the acetate group of the vinyl acetate per 100 $CH_2$ groups in said terpolymer, b. said wax has a melting point of 85° to 135° C., a dropping point of 95° to 135° C., a density of 0.94 to 1.00 g/cm$^3$, an acid number of 5 to 60 mg KOH/g, and an average mol mass of 500 to 10,000 g/mol, and c. said copolymer has a dropping point of 80° to 110° C. and an acid number of 5 to 200 mg KOH/g.

17. The material of claim 16 wherein said terpolymer comprises 30 to 55 parts by weight of vinyl acetate and 1.0 to 27.5 parts by weight of said ethylene.

18. The material of claim 16 wherein said mol mass is 1,000 to 5,000 g/mol.

19. The material of claim 18 wherein said mol mass is 1,500 to 3,500 g/mol.

20. The material of claim 16 wherein said range is 7 to 15 $CH_3$ groups per 100 $CH_2$ groups in said terpolymer.

21. The material of claim 16 wherein said dropping point of said wax is 100° to 120° C.

22. The material of claim 16 wherein said acid number of said wax is 8 to 30 mg KOH/g.

23. The material of claim 17 wherein said mol mass is 1,500 to 3,500 g/mol, said range is 7 to 15 $CH_3$ groups per 100 $CH_2$ groups in said terpolymer, said dropping point of said wax is 100° to 120° C., and said acid number of said wax is 8 to 30 mg KOH/g.

24. The material of claim 14 wherein the weight ratio of said terpolymer to said copolymer is 1000:1 to 1:10.

25. The material of claim 24 wherein said ratio is 100:1 to 1:5.

* * * * *